US009714159B2

(12) United States Patent
Annala

(10) Patent No.: US 9,714,159 B2
(45) Date of Patent: Jul. 25, 2017

(54) METHOD, AN APPARATUS, AND A COMPUTER PROGRAM FOR CONTROLLING A CONTAINER CARRIER

(71) Applicant: Cargotec Finland Oy, Tampere (FI)

(72) Inventor: Ilkka Annala, Tampere (FI)

(73) Assignee: Cargotec Finland Oy, Tampere (FI)

( * ) Notice: Subject to any disclaimer, the term of this patent is extended or adjusted under 35 U.S.C. 154(b) by 0 days.

(21) Appl. No.: 14/778,411

(22) PCT Filed: Mar. 8, 2013

(86) PCT No.: PCT/FI2013/050258

§ 371 (c)(1),
(2) Date: Sep. 18, 2015

(87) PCT Pub. No.: WO2014/135744

PCT Pub. Date: Sep. 12, 2014

(65) Prior Publication Data

US 2016/0264383 A1 Sep. 15, 2016

(51) Int. Cl.

| | |
|---|---|
| ***B66C 13/48*** | (2006.01) |
| ***B66C 15/00*** | (2006.01) |
| ***B66C 19/00*** | (2006.01) |

(52) U.S. Cl.

CPC ..... *B66C 13/48* (2013.01); *B66C 15/00* (2013.01); *B66C 19/007* (2013.01)

(58) Field of Classification Search

CPC ..... B66C 13/48; B66C 15/00; B66C 19/007
USPC ..... 701/50
See application file for complete search history.

(56) References Cited

U.S. PATENT DOCUMENTS

| | | | | |
|---|---|---|---|---|
| 4,401,181 | A | 8/1983 | Schwarz | |
| 4,716,530 | A | 12/1987 | Ogawa et al. | |
| 6,857,493 | B2 * | 2/2005 | Shupp | B60T 7/16 180/168 |
| 7,308,337 | B2 * | 12/2007 | Sparenborg | B66C 13/48 212/273 |
| 7,627,393 | B2 * | 12/2009 | Sawodny | B66C 13/085 700/228 |
| 7,665,945 | B2 * | 2/2010 | Di Rosa | B65G 63/004 212/325 |
| 7,731,041 | B2 * | 6/2010 | Gredel | B66C 1/104 212/316 |
| 7,898,409 | B2 * | 3/2011 | Loomis | G06F 21/10 340/426.15 |

(Continued)

FOREIGN PATENT DOCUMENTS

| | | |
|---|---|---|
| WO | 9834127 | 8/1998 |

*Primary Examiner* — McDieunel Marc
*Assistant Examiner* — James E Stroud
(74) *Attorney, Agent, or Firm* — Ware, Fressola, Maguire & Barber, LLP

(57) ABSTRACT

The invention relates to a method, an apparatus, and a computer program product for controlling a container carrier comprising receiving position information (20) and receiving route information (22) in the cargo handling area (2) for the container carrier. The invention comprises assigning (24) to the cargo handling area (2) at least two portions comprising different speed categories in response to the route information (22), calculating the speed control information (28) at least in response to the speed category in the position of the container carrier, and sending the speed control information (28) to the drive control system.

12 Claims, 4 Drawing Sheets

(56) References Cited

U.S. PATENT DOCUMENTS

| | | | | |
|---|---|---|---|---|
| 8,054,181 | B2 * | 11/2011 | Van Wyck Loomis | G01S 19/14 340/426.15 |
| 8,103,438 | B2 * | 1/2012 | Petrie | B60T 7/22 340/905 |
| 9,106,826 | B2 * | 8/2015 | Aoki | H04N 5/23212 |
| 2009/0129904 | A1 | 5/2009 | Bauer | |
| 2009/0222159 | A1 | 9/2009 | Bauer | |
| 2010/0198492 | A1 * | 8/2010 | Watanabe | B60W 40/12 701/124 |

* cited by examiner

2
D2
SC6
R3
SC5
SC2
SC4
R2
STS
SC1
1

METHOD, AN APPARATUS, AND A COMPUTER PROGRAM FOR CONTROLLING A CONTAINER CARRIER

FIELD OF THE INVENTION

The invention relates to container carriers in ports and terminals. More specifically, the invention relates to a method, an apparatus and a computer program product for controlling a container carrier.

BACKGROUND OF THE INVENTION

Container carriers such as port cranes, rubber tyred gantry cranes (RTG), shuttle carriers, straddle carriers or transporting carriers are used in ports and terminals for transporting cargo containers. Great quantities of containers are to be unloaded, placed in intermediate storage and reloaded for another mode of transportation.

The ship to shore crane, STS, lifts containers for loading and unloading ships. The movement of the port crane is usually limited to rails. The straddle carrier or transporting carrier transports containers between the port crane and a storage area. The freely moving container carrier operates in the cargo handling area. One major risk involved with such freely moving carriers is falling over. This may occur when the loading and unloading of the vessel must be done as quickly as possible. Any additional delays and disturbances result in extra costs by having ships idle in the berth, and even more so if the loading/unloading is for some reason delayed, thus making the ship late in her route schedule.

The stability of the container carrier, such as a straddle carrier, needs to be improved to avoid any accidents. Speed limits in certain areas could lead to slower handling of the cargo. In addition, freely moving container carriers have no specific routes; instead, operators may choose any appropriate route to the destination using the free area in the port or terminal field.

SUMMARY

The invention discloses a method for controlling a container carrier, comprising receiving position information and receiving route information in the cargo handling area for the container carrier. According to the invention the method comprises assigning to the cargo handling area at least two portions comprising different speed categories in response to the route information, calculating the speed control information at least in response to the speed category in the position of the container carrier, and sending the speed control information to the drive control system. The cargo handling area refers to the area assigned for transporting the containers in the port or terminal area or the area where container carriers, for example straddle carriers, are assigned to operate. The speed control information refers to the information sent to the engine management system or to the automated braking system. The speed control information may also refer to the information sent to the driver for alerting too high speed. The information may be a warning light, an icon in the dashboard, a voice or a sound.

In one embodiment the method comprises assigning a first speed category comprising no speed limit and at least a second speed category comprising a reduced speed.

In one embodiment the method comprises assigning at least a second speed category to an area near a turning point in the route. Nearness of a turning point is defined by the ability to safely reduce speed before starting the turning manoeuvre. The distance to a turning point may be defined by the speed of the container carrier; at higher speeds the area near the turning point may be defined larger than at moderate speeds. Such assignments may also be executed to third or fourth speed categories.

In one embodiment the method comprises calculating the speed control information in response to the weight or lifting height of the container. This affects the centre of gravity of the container carrier. If the centre of gravity is higher due to heavy load or the load is carried high during the transport, the speed control information is reduced accordingly. In one embodiment the speed control information is calculated in response to the expected turning radius of the container carrier. The centrifugal force is increased due to smaller turning radius, which causes lower speed control information.

Another aspect of the invention discloses an apparatus for controlling a container carrier comprising at least one processor and at least one memory including computer program code; the at least one memory and the computer program code are arranged to, with the at least one processor, cause the apparatus at least to perform: receiving position information, and receiving route information in the cargo handling area for the container carrier, characterized by assigning to the cargo handling area at least two portions comprising different speed categories in response to the route information, calculating the speed control information at least in response to the speed category in the position of the container carrier, and sending the speed control information to the drive control system.

A third aspect of the invention discloses a computer program product for controlling a container carrier comprising a computer-readable medium bearing computer program code embodied therein for use with a computer, the computer program code comprising: code for receiving position information, and code for receiving route information in the cargo handling area for the container carrier. According to the invention the code further comprises code for assigning to the cargo handling area at least two portions comprising different speed categories in response to the route information, code for calculating the speed control information at least in response to the speed category in the position of the container carrier, and code for sending the speed control information to the drive control system.

In one embodiment the computer program code comprises code for assigning a first speed category comprising no speed limit and at least a second speed category comprising a reduced speed. In one embodiment the computer program code comprises code for assigning at least a second speed category near a turning point in the route. In one embodiment the computer program code comprises code for calculating the speed control information in response to the weight and/or lifting height of the container.

The invention alleviates the container carrier's tendency of falling over. If the operator attempts to approach a curve too fast, the present invention automatically slows down the container carrier. The route planning in the port terminal area is dynamic as it may change for each individual container transport. The routing may be a result of many aspects such as efficient flow of stacked containers. Still, there are certain areas where a turning point is anticipated. The present invention may be used for example to assign any anticipated turning points or areas near an anticipated turning point and slow down the container carrier if the speed of the container carrier is too high to manage the turning manoeuvre. In one aspect the invention provides an intelligent speed adaptation to a free area based on the routing capabilities of the port cargo management system.

BRIEF DESCRIPTION OF THE DRAWINGS

The accompanying drawings, which are included to provide a further understanding of the invention and constitute a part of this specification, illustrate embodiments of the invention and together with the description help to explain the principles of the invention. In the drawings.

DETAILED DESCRIPTION OF THE INVENTION

Reference will now be made in detail to the embodiments of the present invention, examples of which are illustrated in the accompanying drawings.

Figure 1A:
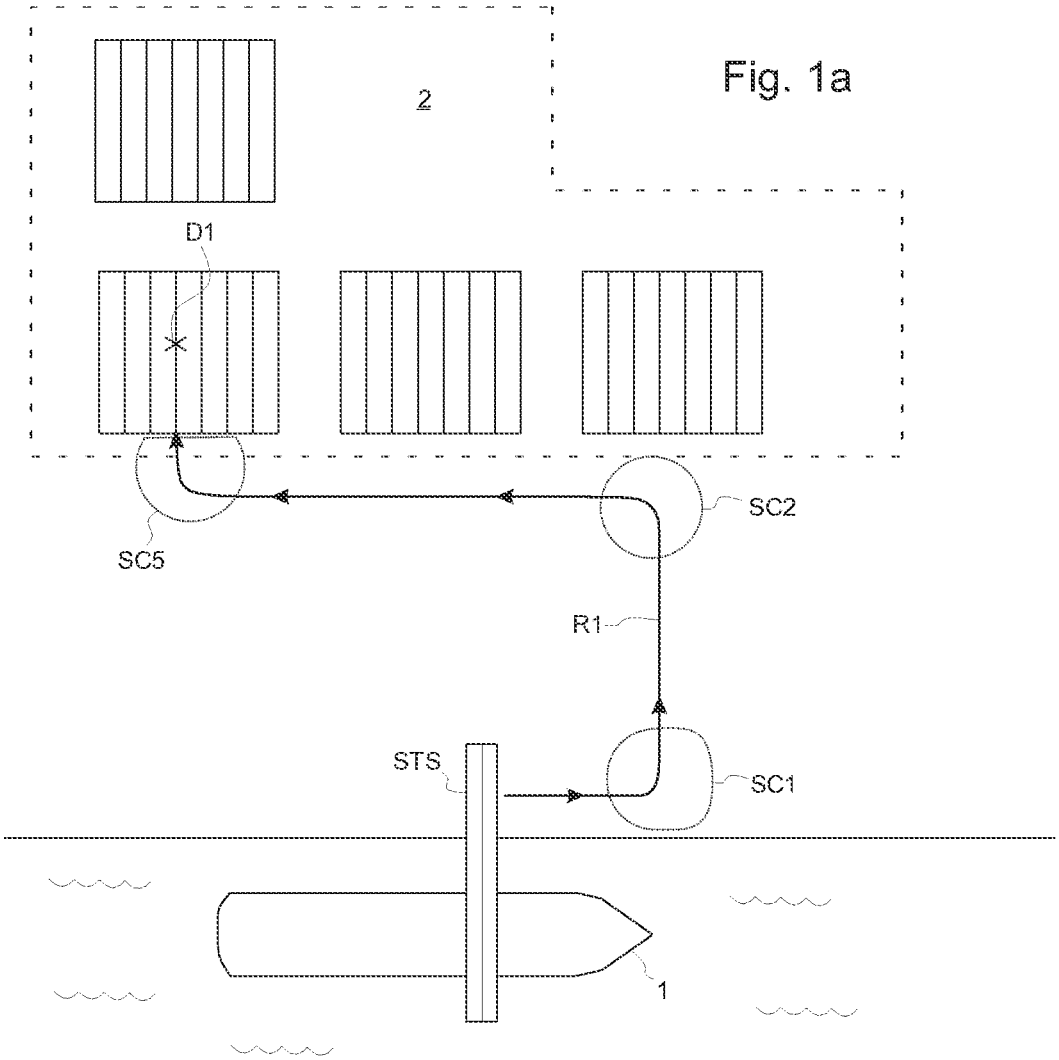
FIGS. 1*a*-1*c* are simplified illustrations of a port terminal area with different routing examples.

FIG. 1*a* illustrates the port or container terminal area where the container carriers are assigned to operate. The container terminal is an area designated for the handling, storage, loading or unloading from one mode of transport to another. Examples of different modes of transport are rail, truck, vessel or barge. The ship 1 is in berth, moored or secured to a place alongside a quay where loading or discharging cargo takes place. Containers are transported between the ship 1 and the shore with a Ship To Shore Gantry Crane STS. A container carrier, for example a straddle carrier, is assigned to move the container from the shoreline to a container handling and storage facility, i.e. a container yard 2.

Figure 1B:
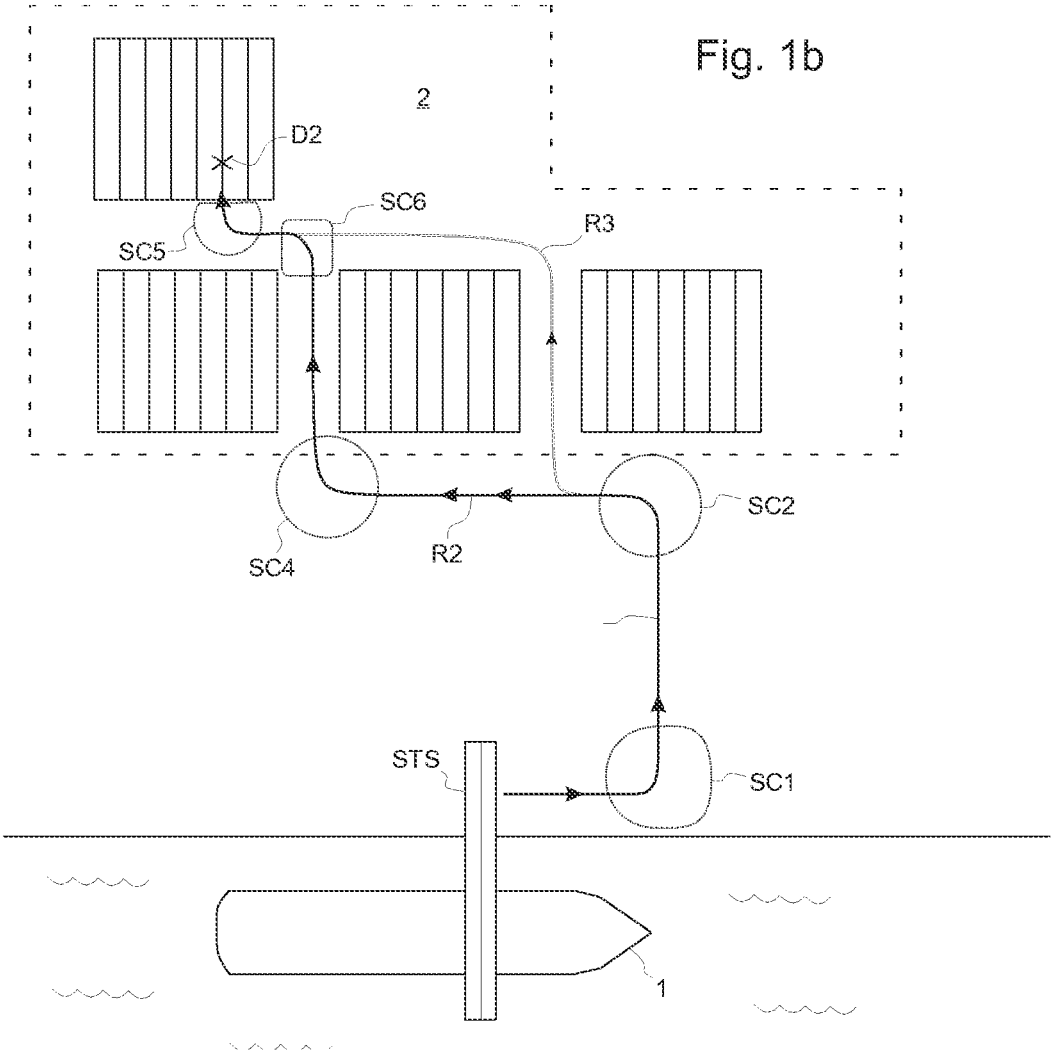
Figure 1C:
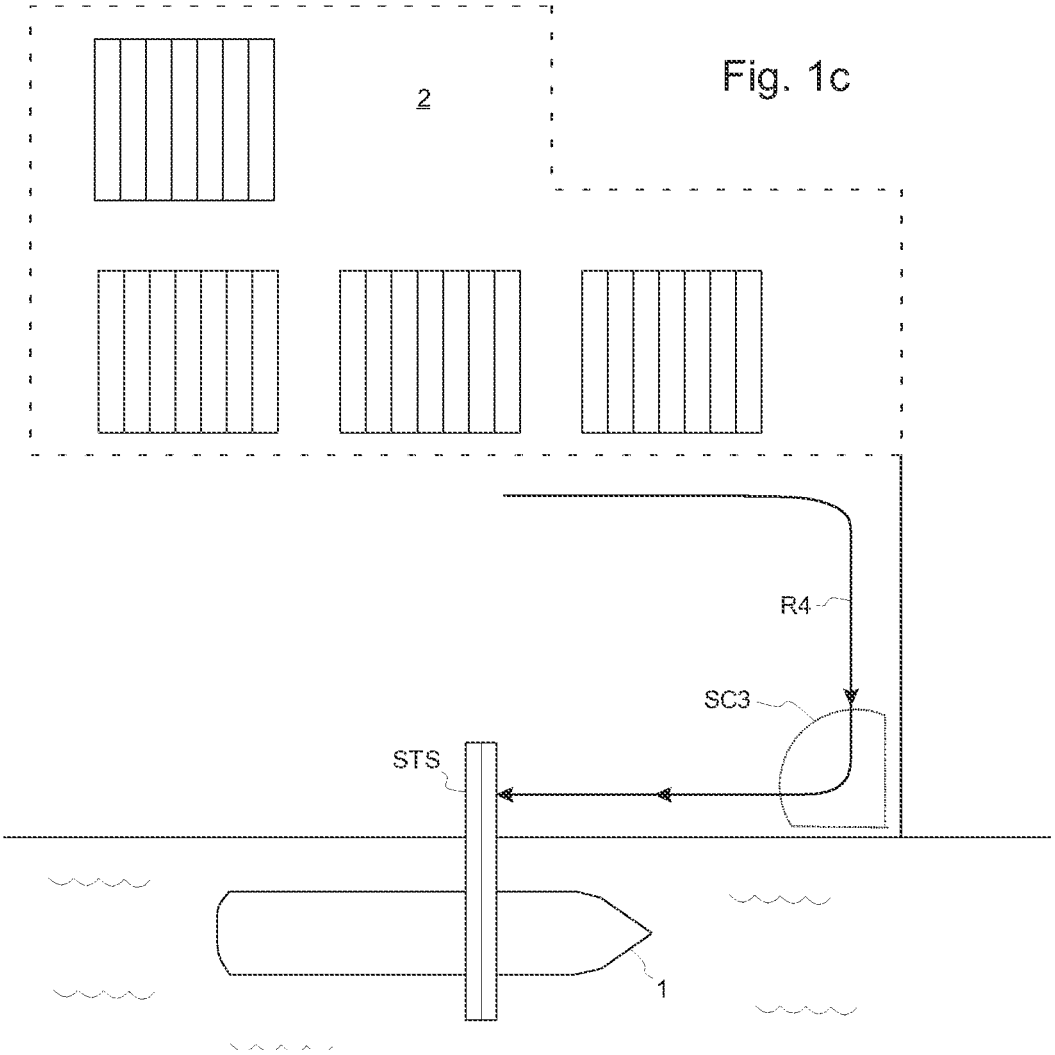

Referring to FIGS. 1*a*-1*c*, lines R1, R2, R3 with arrows pointing the direction refer to the dynamic routing information. According to an embodiment the first speed category with no speed limit applies everywhere except on the areas of anticipated turns SC1-SC5. The speed category may be the same or different in areas SC2-SC5. According to the first route example R1, as illustrated in FIG. 1*a*, the container carrier is leaving the STS crane for the destination D1. In the beginning the routing function expects the operator to execute a U-turn, but the area near the STS crane may have a lot of traffic and there is no exact information of the actual turning point in the area SC1. In this case the area SC1 may be assigned to the end of the shoreline operation area, where the operator must turn the direction of the container carrier in order to stay in the area. The area may be limited by a fence or the shoreline.

As the route R1 approaches the container yard and container stacks, the routing function acknowledges that turning in this area SC2 is mandatory. A second speed category is assigned to that area SC2, and the speed of the container carrier is automatically reduced if it exceeds the limits set in the stability management function.

After the turn the container carrier is again assigned to the first speed category without a speed limit. The route R1 passes a crossing SC4 but according to the routing function the container carrier is not expected to turn in that crossing as the shortest route goes straight forward. According to some embodiments the speed category may also be lower in such crossings SC4, SC6 to reduce the risk of collisions with other traffic. As the container carrier approaches the final destination D1, the area around leading to the path between the container stacks SC5 is assigned to a reduced speed category. This speed category may be even lower than previous ones, enabling to remind the container carrier operator of the important turn.

As another example illustrated in FIG. 1*b*, the destination D2 is set to another container stack, where two equal routes, R2 and R3, can be chosen. In this example the operator chooses to take route R2, missing the first possible crossing leading to the destination. In this case the reduced speed category is assigned only to the area SC4, which is, after missing the first crossing, the most likely crossing for the operator to turn the container carrier to. The reduced speed category may be assigned either to all crossings or only to those that are the most likely to include a turning point. According to the route R2, areas SC6 and SC5 are assigned to lower speed categories.

As another example illustrated in FIG. 1*c*, the container carrier returning to the STS crane uses route R4. As the route R4 approaches the shoreline, a reduced speed category is assigned to the area SC3 to prohibit the container carrier from falling to sea. In such situations the present invention may be used as a failsafe mechanism to prevent serious accidents. The invention may be used to stop the container carrier completely if the parameters indicate that the area is not suitable for the container carrier.

Further examples of anticipated speed categories are approaches to a truck loading/unloading terminal or a workshop area. The situation with the truck terminal is similar to the STS crane, the container carrier has limited options to move. The workshop area is a separate area used for maintenance purposes. The workshop area itself may have a fixed speed limit, but the gate or point of entry to the workshop area may be assigned to specific speed category. The container carrier should be able to match the speed in the speed limit area.

The container may also have a preferred direction in the container stack, for example to enable a door to open. The direction of the container may also be provided to the system assigning the speed category. For some container carriers only forward driving is allowed, therefore the route calculation may assume that only forward movement will be used in order to transport the container in the predefined direction to the container stack or to the STS crane.

In one example, the route information applied according to the invention refers to only part of the whole route. The route information may be relevant only to the next crossing or other anticipated turning point. The route information may refer only 20 to 50 meters ahead of the container carrier. The route information may also include the turning radius or the expected turning radius.

The size and the shape of a reduced speed category may vary according to different parameters. If the area is limited by a structure such as a fence, container or shoreline, the shape may follow the structure. Areas close to any structure may be defined to a low speed category to assist the operator in emergency braking. The area may also be round is there is no limiting structures in the vicinity. Different speed category areas may be assigned inside each other, for example an area with a moderate speed category may comprise areas of lower speed categories.

The expected turning radius may also affect to the speed category. The smaller radius causes a lower speed category to be chosen than the larger turning radius.

The map database may also include the shapes of the terrain, steepness or slightly inclined terrain. The turning direction and the steepness of the terrain may also be calculated to cause an appropriate speed category be chosen. If the outside curve of the turn is directed downhill, a lower speed category must be chosen.

Figure 2:
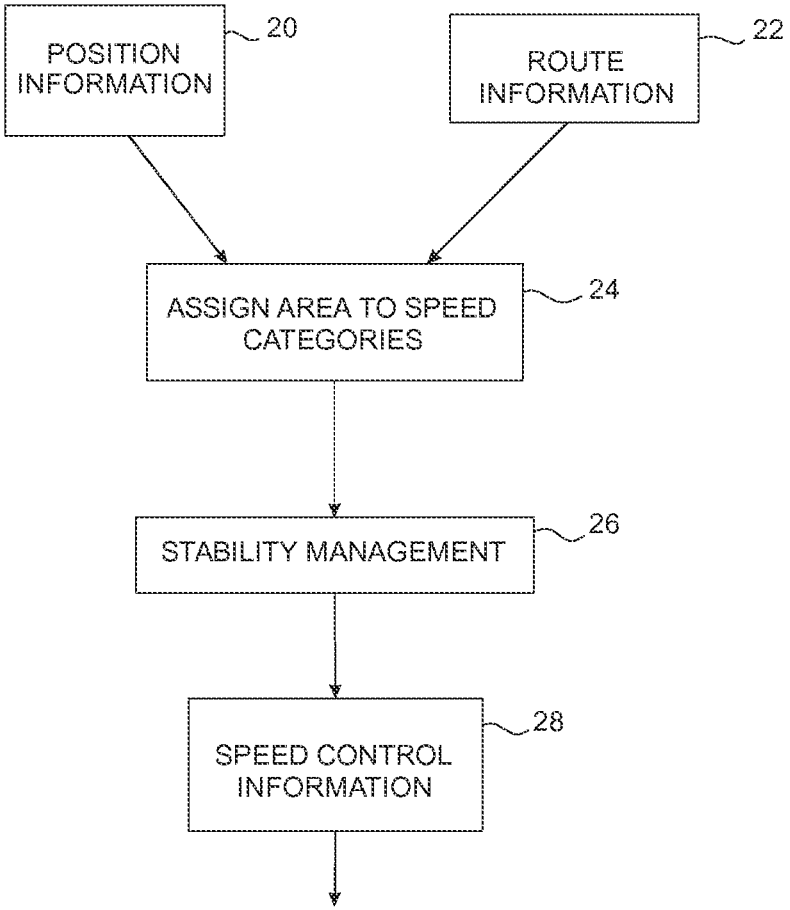
FIG. 2 is a block diagram illustrating the functions of an embodiment according to the invention.

FIG. 2 is a block diagram illustrating different functions according to an embodiment of the invention. Each container has a determined location within the container yard 2. A yard management system is used to enable efficient cargo management. The container carrier has a positioning system such as GPS or a dead-reckoning positioning system, from which the position information 20 is received. The yard management system informs the straddle carrier operator of the location D1 of the container to be transported from/to at the container yard. The operator receives the routing information 22 either as an address of the destination D1 or as more detailed information such as a turn-by-turn route. In either case the operator may freely choose the actual route to the destination D1. If the actual route differs from the initial routing information 22 assigned by the yard management system, it may assign a new route to the destination D1. The routing may be done on a specific routing computer or by routing software implemented to function with the yard management system. In one embodiment the routing is done within the container carrier. In this case the container carrier receives the destination information from the yard management system and a routing computer implemented to be a part of the container carrier calculates a route 22 to the destination. The routing function may also be part of software implemented into the container carrier. The routing 22 is according to one embodiment calculated between the actual position of the container carrier and the destination. The routing can be a dynamic function that anticipates the best possible route to the destination periodically or the routing may be always on. Different embodiments of routing, routing computer or routing software refer to the routing function in this document.

The routing function anticipates a turning point in the best possible route to the destination. Examples of such turning points are crossings at the container yard or lanes between container stacks. As an example the container carrier approaches a crossing. The routing function anticipates that turning at that crossing is the best possible route to the destination. It is very likely that the operator would choose that crossing as the turning direction.

The routing function assigns an area near an anticipated turn to a lower speed category, block 24. The size of the reduced speed category may depend on the current speed of the container carrier. The routing function may recalculate the area of the reduced speed category several times, periodically or in real time during the transportation. The container carrier's stability management function may calculate the distance required for the safe turning radius and whether that fits inside the safe area without colliding into any structure.

The stability management function 26 may use one or more factors to calculate the speed control information. Examples of such factors are: the speed of the container carrier, the anticipated turning radius, the lifting height of the container and the weight of the container. The anticipated turning radius may be derived from the specific path that the container carrier must follow, such as lanes between container stacks. The lifting height information and the weight information are derived from the operational systems of the container carrier in a manner known to a man skilled in the art. The lifting height and the weight of the container affect the container carrier's centre of gravity. In one embodiment the stability management function uses the centre of gravity information to reduce the speed control information.

The stability management function sends the speed control information to the drive control system, block 28. The drive control system slows down the container carrier to a speed that allows the container carrier to complete the turning manoeuvre safely. The speed may be reduced by lowering the speed control information or by applying brakes in the container carrier.

The invention offers an adaptive speed management to a freely operated area by predefined rules that anticipate a turning point in the path of a container carrier. The invention also increases the reaction for the stability management function. As the speed differential between too much speed and within speed limits for the stability management function is handled within a longer time period, critical situations are handled in a smoother manner. This further improves the overall security of the container management system.

Embodiments of the present invention may be implemented in software, hardware, application logic or a combination of software, hardware and application logic. In an example embodiment, the application logic, software or instruction set is maintained on any one of various conventional computer-readable media. In the context of this document, a "computer-readable medium" may be any media or means that can contain, store, communicate, propagate or transport the instructions for use by or in connection with an instruction execution system, apparatus, or device, such as a computer. A computer-readable medium may comprise a computer-readable storage medium that may be any media or means that can contain or store the instructions for use by or in connection with an instruction execution system, apparatus, or device, such as a computer. The exemplary embodiments can store information relating to various processes described herein. This information can be stored in one or more memories, such as a hard disk, optical disk, magneto-optical disk, RAM, and the like. One or more databases can store the information used to implement the exemplary embodiments of the present inventions. The databases can be organized using data structures (e.g., records, tables, arrays, fields, graphs, trees, lists, and the like) included in one or more memories or storage devices listed herein. The processes described with respect to the exemplary embodiments can include appropriate data structures for storing data collected and/or generated by the processes of the devices and subsystems of the exemplary embodiments in one or more databases.

All or a portion of the exemplary embodiments can be conveniently implemented using one or more general purpose processors, microprocessors, digital signal processors, micro-controllers, and the like, programmed according to the teachings of the exemplary embodiments of the present inventions, as will be appreciated by those skilled in the computer and/or software art(s). Appropriate software can be readily prepared by programmers of ordinary skill based on the teachings of the exemplary embodiments, as will be appreciated by those skilled in the software art. In addition, the exemplary embodiments can be implemented by the preparation of application-specific integrated circuits or by interconnecting an appropriate network of conventional component circuits, as will be appreciated by those skilled in the electrical art(s). Thus, the exemplary embodiments are not limited to any specific combination of hardware and/or software.

If desired, the different functions discussed herein may be performed in a different order and/or concurrently with each other.

Furthermore, if desired, one or more of the above-described functions may be optional or may be combined. Although various aspects of the invention are set out in the independent claims, other aspects of the invention comprise other combinations of features from the described embodiments and/or the dependent claims with the features of the independent claims, and not solely the combinations explicitly set out in the claims.

It is obvious to a person skilled in the art that with the advancement of technology, the basic idea of the invention may be implemented in various ways. The invention and its embodiments are thus not limited to the examples described above; instead they may vary within the scope of the claims.

The invention claimed is:

1. A method for controlling a container carrier by an apparatus comprising at least one processor and at least one memory including computer program code, comprising:

receiving, by the apparatus, position information, and receiving route information in a cargo handling area for the container carrier, characterized by assigning to the cargo handling area at least two portions comprising different speed categories in response to the route information, calculating, by the apparatus, speed control information at least in response to the speed category in the position of the container carrier and the weight or lifting height of the container, and sending, by the apparatus, the speed control information to a drive control system.

2. The method according to claim 1, characterized by assigning a first speed category comprising no speed limit and at least a second speed category comprising a reduced speed.

3. The method according to claim 1, characterized by assigning at least a second speed category to an area near a turning point in the route.

4. The method according to claim 1, characterized by calculating the speed control information in response to an expected turning radius of the container carrier.

5. An apparatus for controlling a container carrier comprising at least one processor and at least one memory including computer program code; the at least one memory and the computer program code being arranged to, with the at least one processor, cause the apparatus at least to perform:

receiving position information, and receiving route information in a cargo handling area for the container carrier, characterized by assigning to the cargo handling area at least two portions comprising different speed categories in response to the route information, calculating speed control information at least in response to the speed category in the position of the container carrier and the weight or lifting height of the container, and sending the speed control information to a drive control system.

6. The apparatus according to claim 5, characterized by assigning a first speed category comprising no speed limit and at least a second speed category comprising a reduced speed.

7. The apparatus according to claim 5, characterized by assigning at least a second speed category to an area near a turning point in the route.

8. The apparatus according to claim 5, characterized by calculating the speed control information in response to an expected turning radius of the container carrier.

9. A computer program product for controlling a container carrier comprising a non-transitory computer-readable medium bearing computer program code embodied therein for use with a computer, the computer program code comprising:

code for receiving position information, and code for receiving route information in a cargo handling area for the container carrier, characterized by the code further comprising:

code for assigning to the cargo handling area at least two portions comprising different speed categories in response to the route information, code for calculating speed control information at least in response to the speed category in the position of the container carrier and the weight or lifting height of the container, and code for sending the speed control information to a drive control system.

10. The computer program product according to claim 9, characterized by the computer program code comprising code for assigning a first speed category comprising no speed limit and at least a second speed category comprising a reduced speed.

11. The computer program product according to claim 9, characterized by the computer program code comprising code for assigning at least a second speed category around a turning point in the route.

12. The computer program product according to claim 9, characterized by the computer program code comprising code for calculating the speed control information in response to an expected turning radius of the container carrier.

* * * * *